US006774331B1

(12) United States Patent
Den Ridder et al.

(10) Patent No.: US 6,774,331 B1
(45) Date of Patent: Aug. 10, 2004

(54) PRESSURE SENSITIVE SWITCH

(75) Inventors: Frank Petrus Den Ridder, Zevenbergen (NL); Hans Johannes Eckhardt, Delfgauw (NL)

(73) Assignees: Vitelec B.V., Breda (NL); Tensor B.V., Zoetermeer (NL); Smartsense B.V., Breda (NL)

( * ) Notice: Subject to any disclaimer, the term of this patent is extended or adjusted under 35 U.S.C. 154(b) by 0 days.

(21) Appl. No.: 10/312,735

(22) PCT Filed: Jul. 2, 2001

(86) PCT No.: PCT/NL01/00497

§ 371 (c)(1),
(2), (4) Date: Jul. 23, 2003

(87) PCT Pub. No.: WO02/01586

PCT Pub. Date: Jan. 3, 2002

(30) Foreign Application Priority Data

Jun. 30, 2000 (NL) ..... 1015577

(51) Int. Cl.[7] ..... H01H 1/10; H01H 3/02; H01H 13/702

(52) U.S. Cl. ..... 200/512; 200/86 R

(58) Field of Search ..... 200/85 R, 85 A, 200/86 R, 83 N, 61.43, 61.54, 512–517

(56) References Cited

U.S. PATENT DOCUMENTS 4,137,116 A * 1/1979 Miller ..... 200/86 R
4,525,606 A * 6/1985 Sado ..... 200/86 R
4,639,559 A * 1/1987 Taguchi ..... 200/86 R
4,677,417 A * 6/1987 Amagishi ..... 200/86 R
5,399,819 A 3/1995 Lang et al. ..... 200/86 R
5,723,834 A * 3/1998 Hambleton, Jr. et al. 200/61.54
5,818,002 A 10/1998 Kurtz et al. ..... 200/83 N
5,895,900 A 4/1999 Okada et al. ..... 200/61.54

FOREIGN PATENT DOCUMENTS

EP 0 669 229 8/1995
FR 2 148 063 3/1973
WO WO-02.01586 A1 * 1/2002 ..... H01H/3/14

* cited by examiner

*Primary Examiner*—James R. Scott
(74) *Attorney, Agent, or Firm*—Young & Thompson

(57) ABSTRACT

A pressure-sensitive switch, includes: an edge structure extending in a substantially closed contour; a first carrier which is connected on its edges to the edge structure and which is electrically conductive on its side connected to the edge structure; a second carrier which is connected on its edges to the edge structure and which extends substantially parallel to the first carrier and is electrically conductive on its side connected to the structure; and connecting elements for connecting the external connections to the first and the second carrier, wherein the distance between the carriers in their neutral position is substantially the same over the whole surface by a spacer which holes or by a set of spacers attached to at least one of the carriers. Owing to this uniform spacing between the carriers the switch is identical over its whole active surface, so that no local aberrations such as dimples have to be made. The switch can hereby be miniaturized more easily. This uniformity also ensures that the sensitivity of the switch extends over its whole surface.

20 Claims, 1 Drawing Sheet

PRESSURE SENSITIVE SWITCH

BACKGROUND OF THE INVENTION

The invention relates to a pressure-sensitive switch, comprising: an edge structure extending in a substantially closed contour; a first carrier which is connected on its edges to the edge structure and which is electrically conductive on its side connected to the edge structure; a second carrier which is connected on its edges to the edge structure and which extends substantially parallel to the first carrier and is electrically conductive on its side connected to the structure; and connecting means for connecting the external connections to the first and the second carrier.

DESCRIPTION OF THE RELATED ART

Such a switch is known from U.S. Pat. No. 5,818,002.

In this known switch the carriers are formed by relatively thick plates which are provided in their centre with an inward directed dimple. When pressure is exerted on the plates they will bend and move towards each other in the centre so that the dimples can make mutual electrical contact. It is possible to adjust the sensitivity of the switch by modifying the form and depth of the dimples.

This is however a switch of a rugged type which does not lend itself to miniaturization and which only operates properly when a force is exerted on the plates in the vicinity of the dimple.

SUMMARY OF THE INVENTION

The object of the present invention is to provide such a device which is suitable for miniaturization and which responds when a force is exerted at any random location on its surface.

This objective is achieved in that the distance between the carriers in their neutral position is substantially the same over the whole surface.

Owing to this uniform spacing between the carriers the switch is identical over its whole active surface, so that no local aberrations such as dimples have to be made. The switch can hereby be miniaturized more easily. This uniformity also ensures that the sensitivity of the switch is the same over its whole surface.

In order to also enable construction of the switch with a comparatively large surface area relative to the thickness, the carriers are preferably manufactured from foil, and spacers are placed between the carriers inside the edge structure, which spacers are fixed to each of the carriers.

The use of spacers makes the use of a flexible carrier possible. The switch can hereby also be made sensitive for a locally applied pressure.

In order to obtain a uniform sensitivity over the surface, the spacers are evenly distributed over the surface inside the structure.

In some situations it is attractive if the spacers are distributed in a pattern with varying density over the surface inside the structure.

The sensitivity can hereby be made location-dependent.

Other attractive embodiments are stated below.

BREIF DESCRIPTION OF THE DRAWINGS

The present invention will be elucidated hereinbelow with reference to the annexed figures, in which.

DESCRIPTION OF THE PREFERRED EMBODIMENTS

Figure 1:
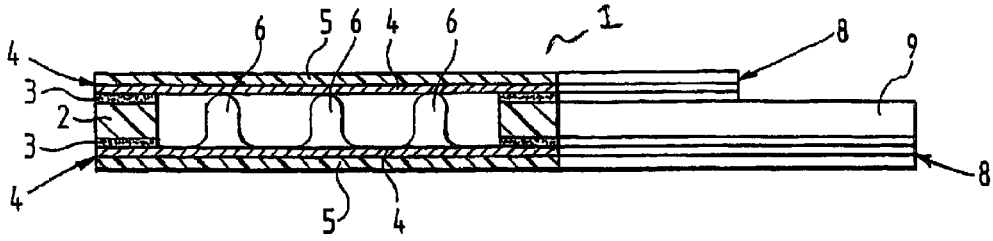
FIG. 1 shows a cross-sectional view of a first embodiment of the invention.

FIG. 1 shows a cross-section of a switch according to the invention designated in its entirety as switch 1.

Adhered to edge structure 2 is a foil 4 which is formed by a layer of plastic 5 and a layer of metal 12, for instance aluminium. Metal layer 12 is herein directed toward the interior of switch 1. Such a foil 4 is also adhered to the other side of edge structure or peripheral structure 2, wherein metal layer 12 faces toward the interior of switch 1.

A number of spacers 6 are placed on the innermost foil 4. These spacers are preferably formed by plastic globules applied to foil 4 by means of screen-printing. Owing to the screen-printing process they take the form of a bell in the cross section.

It is pointed out here that the dimensions of the switch can vary widely; the switch is intended in the first instance for small design. Envisaged here are dimensions of the foils of several square centimeters and a thickness of less than 1 millimeter. In this anticipated configuration the distance between the foils is 0.08 mm. The mutual distance between the spacers amounts to 2.3 mm. The spacers are herein ordered in a square grid. Such a switch is suitable for switching at a pressure force of 0.75 N.

It is of course possible to construct a switch according to the invention with other dimensions. The distance between the foils can be reduced to 0.05 or even to 0.03 mm. It is advisable here to adapt the other dimensions of the switches accordingly, and thus apply for instance a proportionally thinner foil.

In order to adjust the sensitivity of the switch it is possible to modify the surface density of the spacers. It is even possible to vary the density of the spacers as to realize a sensitivity which differs for instance according to the position of pressure.

It is of course likewise possible to enlarge or reduce the total surface area of the switch subject to the application.

The flexibility of foils 4 and of edge structure 2 makes it possible to bend switch 1 without exerting a significant influence on the sensitivity thereof. It is important herein that spacers 6 are fixed to only one of the two foils 4. The adhesion between foils 4 and the edge structure 2 is also important here. This is because adhesive layer 3 must allow a displacement between the foils during bending.

In order to make a connection the two foils 4 are provided with an extension 8 which is suitable for connection to a wire or conductive track on a printed circuit board by means of a connector or a soldered joint. In order to prevent short-circuiting between the foils the edge structure 2 is also provided with an extension 9 which extends between the extensions of the foils. The extensions preferably have an unequal length so as to prevent coincidence of the thickened portions caused by a connector or soldered joint.

The operation of the switch is such that the foils 4 are normally separated from each other by edge structure 2, spacers 6 and the layer of air between foils 4. When one or both of the foil layers 4 is pressed in, foils 4 will make local contact with each other, whereby the switch closes. It is mainly the flexibility of the foils 4 which is used here to bring foils 4 into mutual contact. Spacers 6 are after all relatively rigid; they yield only to a small extent.

It is however possible to make use of other types of spacer which do yield to a significant degree. It is then possible to make use of less flexible foils.

Figure 2:
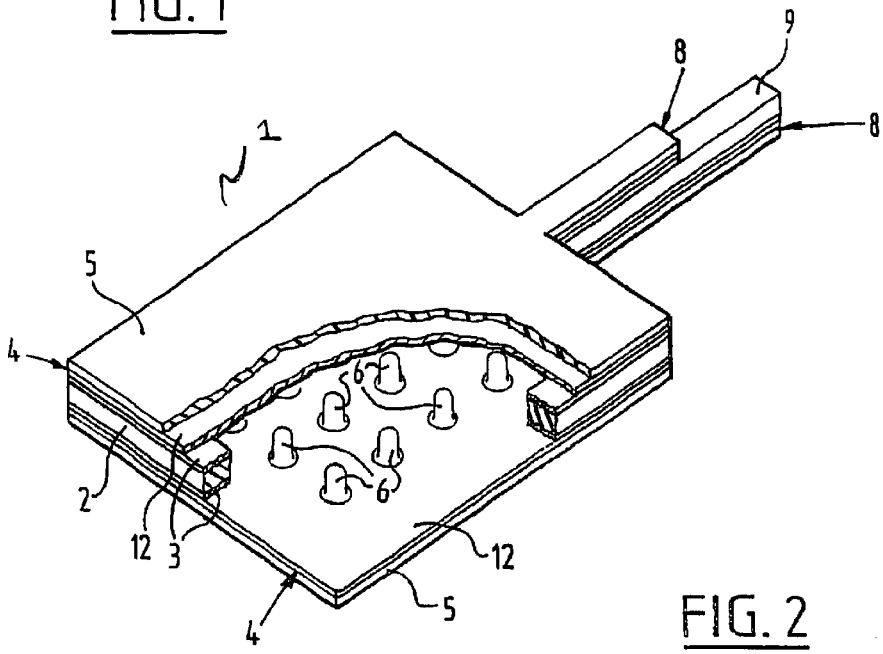
FIG. 2 is a partly broken-away view of the embodiment shown in FIG. 1.

FIG. 2 shows the same embodiment, wherein the structure is shown more clearly.

Figure 3:
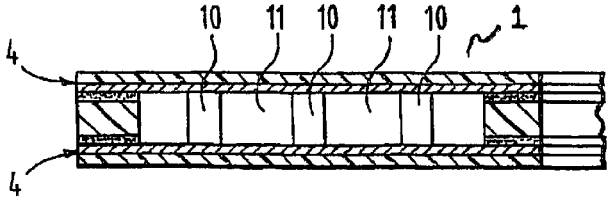
FIG. 3 shows a cross-sectional view of a second embodiment of the invention.

Finally, FIG. 3 shows a cross-sectional view of such a switch wherein use is made of a different type of spacer. Use is made in this embodiment of a single spacer 10 which is provided with holes 11 distributed uniformly over the surface.

When a force is exerted on foils 4, the foils will be moved toward each other and make mutual contact so that the switch is closed. As in the first embodiment above, use is herein made of the flexibility of the foil. In this configuration the resilience of the spacer will be necessary to enable the foils to move toward each other, unless the holes 11 are relatively large.

What is claimed is:

1. Pressure-sensitive switch, comprising:

an edge structure extending in a substantially closed contour;

a first carrier which is connected on its edges to the edge structure and which is electrically conductive on its side connected to the edge structure;

a second carrier which is connected on its edges to the edge structure and which extends substantially parallel to the first carrier and is electrically conductive on its side connected to the edge structure;

spacers placed between the carriers inside the edge structure and fixed to at least one of the first and second carriers; and connecting means for connecting the external connections to the first and the second carrier, the distance between the carriers in their neutral position being substantially the same over the whole surface, the edge structure comprising double-sided adhesive tape, the adhesive layers thereof allowing a displacement between said first and second carriers, the switch becoming conductive upon the electrically conductive sides of the first and second carriers being brought into contact with each other.

2. Switch as claimed in claim 1, wherein, the first and second carriers each comprise a foil, the foils facing each other and brought into contact with each other to make the switch conductive, and the spacers are fixed to only one of said foils.

3. Switch as claimed in claim 2, wherein each foil is formed by metal foil, to an outermost switch side of which metal foil is applied a plastic layer.

4. Switch as claimed in claim 1, wherein the spacers are evenly distributed inside the edge structure.

5. Switch as claimed in claim 4, wherein the spacers are fixed to both the first and second carriers to form a connected structure.

6. Switch as claimed in claim 1, wherein the spacers are distributed in a pattern with varying density over an innermost surface of the at least one of the first and second carriers inside the edge structure.

7. Switch as claimed in claim 4, wherein the spacers are screen-printing spacers attached to an innermost surface of the at least one of the first and second carriers.

8. Switch as claimed in claim 1, wherein the connecting means comprise extensions of the carriers outside the edge structure.

9. Switch as claimed in claim 8, wherein the extensions of the carriers are separated by an extension of the edge structure.

10. Switch as claimed in claim 8, wherein the extensions of the carriers are of unequal length.

11. Switch as claimed in claim 1, wherein the thickness of the switch is less than 1 millimeter.

12. Switch as claimed in claim 9, wherein the extensions of the carriers are of unequal length.

13. Pressure-sensitive switch, comprising:

an edge structure extending in a substantially closed contour;

a first carrier connected on its edges to the edge structure and having an electrically conductive side connected to the edge structure;

a second carrier connected on its edges to the edge structure, extending substantially parallel to the first carrier, and having an electrically conductive side connected to the edge structure;

a spacer with holes located intermediate the first and second carriers inside the edge structure and fixed to at least one of the first and second carriers; and connecting means for connecting the external connections to the first and the second carrier, the distance between the first and second carriers in their neutral position being substantially the same over the whole exterior switch surface, the edge structure comprising double-sided adhesive tape with adhesive layers allowing a displacement between said first and second carriers, the switch becoming conductive upon the electrically conductive sides of the first and second carriers being brought into contact with each other.

14. Switch as claimed in claim 13, wherein, the spacer is fixed to one of electrically conductive sides.

15. Switch as claimed in claim 14, wherein each of the first and second carriers comprise a metal foil attached to a plastic layer.

16. Switch as claimed in claimed 13, wherein the holes are evenly distributed over a complete surface of the spacer.

17. Switch as claimed in claim 13, wherein the spacer is fixed to both the first and second carriers to form a connected structure.

18. Switch as claimed in claim 13, wherein the connecting means comprise extensions of the first and second carriers outside the edge structure.

19. Switch as claimed in claim 18, wherein the extensions of the carriers are separated by an extension of the edge structure.

20. Switch as claimed in claim 18, wherein the extensions of the carriers are of unequal length.

* * * * *